United States Patent [19]

Sakurai

[11] Patent Number: 4,777,484

[45] Date of Patent: Oct. 11, 1988

[54] DISPLAY CONTROL DEVICE

[75] Inventor: Atsushi Sakurai, Yokohama, Japan

[73] Assignee: Canon Kabushiki Kaisha, Tokyo, Japan

[21] Appl. No.: 18,741

[22] Filed: Feb. 24, 1987

Related U.S. Application Data

[63] Continuation of Ser. No. 630,343, Jul. 13, 1984, abandoned, which is a continuation of Ser. No. 372,554, Apr. 28, 1982, abandoned, which is a continuation of Ser. No. 152,733, May 23, 1980, abandoned.

[30] Foreign Application Priority Data

Jun. 5, 1979 [JP] Japan ..... 54-70395

[51] Int. Cl.[4] ..... G09G 3/00

[52] U.S. Cl. ..... 340/715; 340/750; 340/798

[58] Field of Search ..... 340/750, 798, 799, 800, 340/801, 715

[56] References Cited

U.S. PATENT DOCUMENTS

| | | | |
|---|---|---|---|
| 3,396,377 | 8/1968 | Strout | 340/790 |
| 3,786,475 | 1/1974 | Staar | 340/798 |
| 3,849,773 | 11/1974 | Katahira et al. | 340/801 |
| 3,864,677 | 2/1975 | Bekki | 340/715 |
| 4,196,413 | 4/1980 | Sowa | 340/715 |
| 4,287,503 | 9/1981 | Sumida | 340/715 |
| 4,504,826 | 3/1985 | Leininger | 340/745 |

FOREIGN PATENT DOCUMENTS

| | | | |
|---|---|---|---|
| 54-121099 | 9/1979 | Japan | 340/715 |

*Primary Examiner*—Marshall M. Curtis

*Attorney, Agent, or Firm*—Fitzpatrick, Cella, Harper & Scinto

[57] ABSTRACT

There is disclosed a display control device having plural memories for storing information, an address unit for generating an address signal to select one of said plural memories, said address unit comprising an address memory for storing said address signal, an output device connected to said address unit and adapted to read said information from one of said plural memories in response to said address signal stored in said address memory, and a display connected to said output device for displaying said information supplied by said output device. None of said memories stores an alarm message which is displayed during overflow, for example.

12 Claims, 2 Drawing Sheets

DISPLAY CONTROL DEVICE

This application is a continuation of application Ser. No. 630,343 filed July 13, 1984, now abandoned, which was a continuation of application Ser. No. 372,554, filed Apr. 28, 1982, now abandoned which was a continuation of application Ser. No. 152,733, filed May 23, 1980, now abandoned.

BACKGROUND OF THE INVENTION

1. Field of the Invention

The present invention relates to a display control device allowing the display of the contents of plural memories.

2. Description of the Prior Art

In the conventional data processing apparatus having a display device, the display of the data stored in a memory is achieved by the transfer of said data from said memory to a display memory.

For this reason, in order to achieve the display of urgent information without destroying the information currently in display, there is required an exclusive circuit for urgent information display such as a lamp or memory means for temporarily diverting the information currently in display, which thus leads to a complicated circuitry.

SUMMARY OF THE INVENTION

In consideration of the foregoing, the object of the present invention is to provide a display control device allowing the display of another data without diverting the data currently in display.

Another object of the present invention is to provide a display control device having plural memories for storing display data, further having an additional memory for selecting either one of said plural memories and adapted to selectively display the content of one of said plural memories by changing the content of said additional memory.

Still other objects of the present invention will be made apparent from the following description of the embodiments to be taken in conjunction with the attached drawings.

DESCRIPTION OF THE PREFERRED EMBODIMENTS

Now the present invention will be clarified in detail by an embodiment thereof applied to the display device of a computer as shown in the attached drawings.

Figure 1:
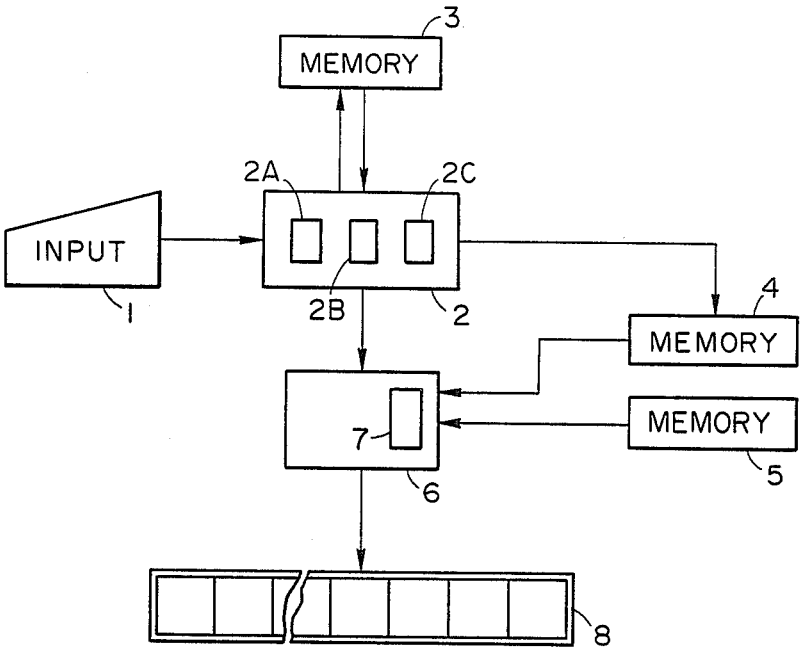
FIG. 1 is a block diagram showing an embodiment of the present invention.

FIG. 1 shows an embodiment of the display control device of the present invention in a block diagram, wherein an input device 1 is provided with plural keys for entering information. A processing unit 2 is provided with a memory 2A storing the instruction sequence for executing the functions to be explained later, a processing circuit 2B for processing the entered information and for conducting logic calculations, and a control circuit 2C for decoding the instruction and executing the corresponding controls, and thus performs the processing of the entered information and releases the thus processed information.

A memory device 3 stores the information entered from the input device 1 through the processing unit 2.

A display memory device 4 stores the information processed by the processing unit 2.

A fixed memory device 5 stores messages to be transmitted to the operator, for example a message "KEY OVERFLOW" in the present embodiment.

A display circuit 6 is provided with an auxiliary memory device 7, selects the display memory device 4 or the fixed memory device 5 according to the content of said auxiliary memory device 7 and transmits the content of thus selected memory device to a display unit 8. The processing unit 2 stores, in the auxiliary memory device 7 provided in the display circuit 6, an address signal for selecting either the display memory device 4 or the fixed memory device 5.

A display unit 8 performs the display of the information transmitted from the display circuit 6.

The function of the above-explained embodiment is as follows.

Referring to FIG. 1, the input information from the input device 1 having plural keys is stored, through the processing unit 2, in the memory device 3.

The processing unit 2 executes the informaiton processing by reading the information in the input order from the memory device 3, and stores the result of said processing in the display memory device 4. Simultaneously the processing unit 2 stores, in the auxiliary memory device 7 provided in the display circuit 6, an address signal (a) for selecting the display memory device 4 as shown in FIG. 3.

Figure 3:
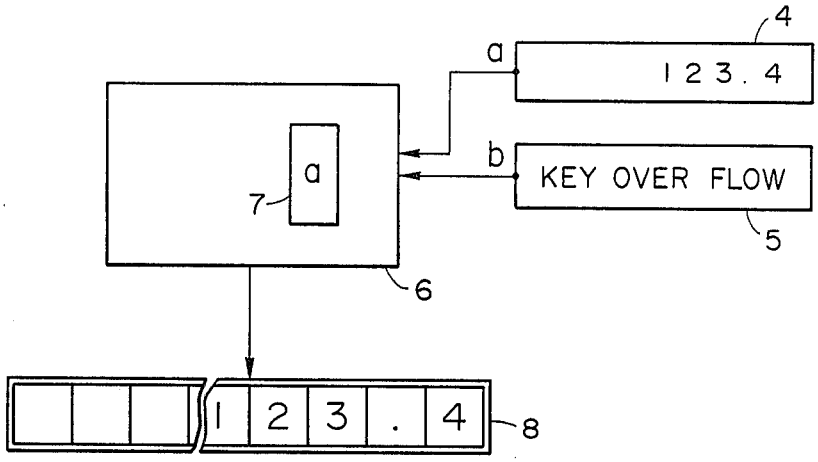
FIG. 3 is a block diagram showing the state of normal display.

The display circuit 6 reads the information from an address corresponding to the content of said auxiliary memory device 7 and displays said information on the display unit 8 as shown in FIG. 3.

Figure 2:
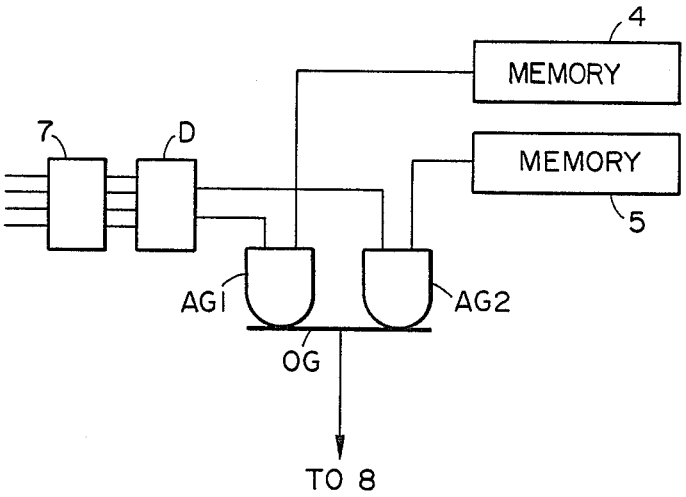
FIG. 2 is a block diagram of a display circuit.

FIG. 2 is a block diagram showing the details of the display circuit 6, in which the data stored in the auxiliary memory device 7 are decoded by a decoder D. In case of selecting the display memory device 4, an address signal (a) is entered in the auxiliary memory device 7 to release a signal from the decoder D for opening an AND gate AG1. On the other hand in case of selecting the fixed memory device 5, an address signal (b) is entered in the auxiliary memory device 7 to open an AND gate AG2 through the decoder D, whereby the content of said fixed memory device is transmitted through said AND gate AG2 and an OR gate OG to the display unit 8.

In case the information entry from the input device 1 is faster than the information readout of the processing unit 2 from the memory device 3, the capacity of the memory device 3, which is inevitably finite, should be filled up sooner or later.

Figure 4:
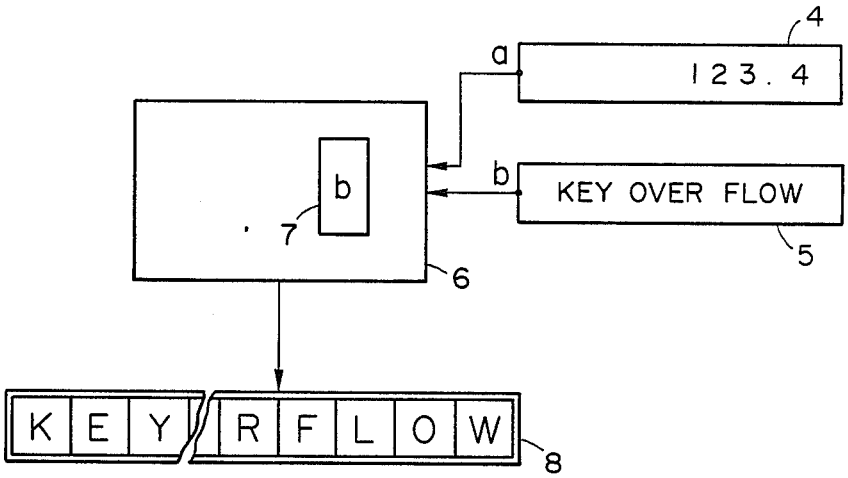
FIG. 4 is a block diagram showing the state of an alarm display indicating an abnormal key input.

In such case the processing unit 2 transmits an address signal (b) to the auxiliary memory device 7 for selecting the fixed memory device 5, as shown in FIG. 4.

The message stored in the fixed memory device, for example a message "KEY OVERFLOW", is thus displayed a shown in FIG. 4 on the display unit 8 through the display circuit 6, thus giving an alarm to the subsequent key input. While the operator interrupts the key input operation, the processing unit 2 continues the execution of instructions, thus eventually creating a vacancy in the memory device 3.

At this state the processing unit 2 again transmits an address signal (a) indicating the display memory device 4 to the auxiliary memory device 7, whereby the display prior to the occurrence of abnormal input is revived by the information retained in the display memory device 4.

In the foregoing embodiment the selection is made between the display memory device and the fixed memory device, but it is also possible to achieve selection between memory devices of a same kind.

As explained in the foregoing, the present invention is effective in achieving the conventionally cumbersome multi-purpose utilization of the display unit in a simple manner by retaining the address signal indicating the address for readout of the information to be displayed in a rewritable auxiliary memory means or a display select memory.

What I claim is:

1. A display control device comprising:
input means for entering information;
a first memory for temporarily storing information entered from said input means;
processing means connected to said first memory for processing information stored in said first memory;
a second memory connected to said processing means for storing information processed by said processing means for subsequent display of said processed information;
display means for displaying information;
a third memory for storing other information to be displayed;
control means connected to said second and said third memories and to said display means, said control means including a fourth memory for storing one of a first memory address signal representing said second memory and a second memory address signal representing said third memory, said control means further including selection means responsive to said first memory address signal and said second memory address signal stored in said fourth memory respectively for causing said display means selectively to display one of the information stored in said second memory and the other information stored in said third memory; said processing means including means for detecting an overlfow state of said first memory, and rewriting means for changing a first memory address signal stored in said fourth memory and representing said second memory to a second memory address signal representing said third memory when said detecting means detects an overflow state of the first memory.

2. A display control device according to claim 1, wherein the third memory comprises a read only memory for storing a message.

3. An information processing system comprising:
manual input means for entering information signals;
first memory means for storing information signals entered by said manual input means;
processing means for processing information signals stored in said first memory means;
second memory means for storing at least a portion of the information signals stored in said first memory means for subsequent display of said portion of the information signals;
third memory means for storing an additional information signal for subsequent display;
display means for displaying information; and
visualization control means for selectively displaying one of an information signal stored in said second memory means and the additional information signal stored in said third memory means, said visualization control means including a fourth memory for storing selecting information and selection means responsive to said selecting information for selecting one of said second memory means and said third memory means to cause dispaly of one of the portion of information signals and additional information stored respectively therein, and wherein selecting information stored in said fourth memory is renewed in accordance with processing by said processing means of information signals stored in said first memory means.

4. An information processing system according to claim 3, wherein said manual input means comprises a keyboard.

5. An information processing system according to claim 4, wherein said third memory means is memory means for storing a message.

6. An information processing system according to claim 3, wherein said third memory is a read only memory for storing a message.

7. An information processing system comprising:
first memory means for storing information signals;
processing means for processing information signals stored in said first memory means;
second memory means for storing at least a portion of the information signals stored in said first memory means for subsequent display of said portion of the information signals;
third memory means for storing an additional information signal for subsequent display;
control means connected to said processing means for alternatively selecting an information signal stored in said second memory means and the additional information signal stored in said third memory means in accordance with a select signal produced by said processing means and for transferring said selected information signal stored in said second memory means or said selected additional information signal stored in said third memory means; and
display means connected to said control means for receiving and displaying an information signal stored in said second memory or the additional information signal stored in said third memory means in accordance with the alternative selection by said control means.

8. An information processing system according to claim 7, wherein said second memory means is a read-write memory and said third memory means is a fixed memory.

9. An information processing system according to claim 7, wherein said control means produces selection information for selecting one of said second memory means and said third memory means, said system further comprising a fourth memory for storing the selection information, and wherein said control means includes selection means for performing said alternate selecting on the basis of selection information stored in said fourth memory.

10. An information processing system according to claim 7, wherein saaid third memory means stores a message.

11. A display control device according to claim 1, wherein said input means includes a plurality of keys.

12. An electronic equipment for displaying information, comprising:

input means for entering information;

a first memory for temporarily storing information entered from said input means;

processing means connected to said first memory for processing information stored in said first memory;.

a second memory connected to said processing means for storing information processed by said processing means for subsequent display of said processed information;

display means for displaying information;

a third memory for storing other information to be displayed; and display control means connected to said second and third memory and to said display means, having a fourth memory for storing one of a first memory address signal representing said second memory and a second memory address signal representing said third memory, said display control means further having selection means responsive to the first memory address signal and the second memory address signal respectively for causing said display means selectively to display one of the information stored in said second memory and the other information stored in said third memory, said selection means repeatedly causing supply of said display means with one of said information and said other information respectively from said first memory and said second memory in response respectively to a first memory address signal and a second memory address signal stored in said fourth memory means.

* * * * *

UNITED STATES PATENT AND TRADEMARK OFFICE

CERTIFICATE OF CORRECTION

PATENT NO. : 4,777,484

DATED : October 11, 1988

INVENTOR(S) : ATSUSHI SAKURAI

It is certified that error appears in the above-identified patent and that said Letters Patent is hereby corrected as shown below: Title page:

IN [57] ABSTRACT

Line 11, "None" should read --One--.

COLUMN 2

Line 63, "a" should read --as--.

COLUMN 3

Line 45, "overlfow" should read --overflow--.

COLUMN 4

Line 9, "dispaly" should read --display--.
Line 23, "memory is" should read --memory means is--.
Line 46, "memory or" should read --memory means or--.
Line 65, "saaid" should read --said--.

Signed and Sealed this

Twentieth Day of February, 1990

*Attest:*

JEFFREY M. SAMUELS

*Attesting Officer* *Acting Commissioner of Patents and Trademarks*